US005407108A

United States Patent [19]

Hambright

[11] Patent Number: 5,407,108

[45] Date of Patent: Apr. 18, 1995

[54] BOW MAKING MACHINE AND METHOD

[76] Inventor: Perry Hambright, 22543 Ventura Blvd. Suite 211, Woodland Hills, Calif. 91364

[21] Appl. No.: 147,733

[22] Filed: Nov. 4, 1993

[51] Int. Cl.[6] ..... A41H 43/00

[52] U.S. Cl. ..... 223/46; 223/44

[58] Field of Search ..... 223/46, 44; 28/147, 28/149, 150; 227/140, 146, 149, 65

[56] References Cited

U.S. PATENT DOCUMENTS

| | | | |
|---|---|---|---|
| 2,335,053 | 11/1943 | Gluck | 223/46 |
| 2,542,222 | 2/1951 | Welch | 223/46 |
| 2,666,249 | 1/1954 | Ruiz et al. | 223/46 |
| 2,763,080 | 9/1956 | Welch | 223/46 |
| 2,933,223 | 4/1960 | Kravig et al. | 223/46 |
| 3,139,225 | 6/1964 | Rector | 223/46 |
| 3,180,542 | 4/1965 | Carmichael | 223/46 |
| 3,223,299 | 12/1965 | Kerrigan et al. | 223/46 |
| 3,225,976 | 12/1965 | Goldfarb | 223/46 |
| 3,249,269 | 5/1966 | Bock et al. | 223/46 |
| 3,291,352 | 12/1966 | Grikis | 223/46 |
| 3,501,071 | 3/1970 | Zadosko | 223/46 |
| 3,661,307 | 5/1972 | Jacobson | 223/46 |
| 4,007,860 | 2/1977 | Glesmann | 223/46 |
| 4,491,261 | 1/1985 | Mitsuhashi | 227/76 |
| 5,072,865 | 12/1991 | Lyons | 223/46 |

*Primary Examiner*—Clifford D. Crowder
*Assistant Examiner*—Amy Brooke Vanatta
*Attorney, Agent, or Firm*—Kelly, Bauersfeld & Lowry

[57] ABSTRACT

A bow making machine includes a magnetized anvil fixed to a base between four upwardly extending, channel-forming posts. The magnetized anvil holds a barrette in place within the channel defined by the posts, and loops of bow-forming ribbon material are placed over the barrette such that a central portion of the ribbon material is also situated between the posts. A ribbon/staple holder is placed over the central portion of the ribbon material to sandwich the barrette and the ribbon material between the ribbon/staple holder and the anvil. A staple is placed within the ribbon/staple holder, and then a punch assembly is pivoted into place to align a punch mechanism with the staple. The punch mechanism is depressed to force the ends of the staple into engagement with the anvil, which has the effect of binding the sandwiched central portion of the ribbon material and the underlying barrette together. The punch assembly may then be pivoted out of the way, the ribbon/staple holder withdrawn from between the posts, and the attached bow-forming ribbon material and barrette removed from the channel defined by the posts. The loops of bow-forming ribbon material may then be spread and shaped as desired.

19 Claims, 5 Drawing Sheets

BOW MAKING MACHINE AND METHOD

BACKGROUND OF THE INVENTION

The present invention relates generally to mechanical devices adapted for forming decorative articles, and related methods. More specifically, the present invention relates to a machine adapted for forming decorative bows comprising superimposed loops of strip material, such as ribbon, tape or the like, and a related method for making such decorative bows.

There is a continuing demand for pre-formed decorative articles such as bows, formed of ribbon or similar materials. Such articles have found wide acceptance and use by individual consumers for various decorative purposes, such as in adorning gift packages, or as a hair accessory, as well as in the commercial sales field where they may serve as embellishments on various items.

The preparation of bows made out of ribbon or any continuous length of strip material involves considerable manual skill and dexterity, and is quite time consuming if done simply on a manual basis. For this reason, a number of machines have been developed for making decorative bows from a continuous length of ribbon whereby such bow making is substantially completely automatic. An example of a successful, early automatic bow making machine is described in U.S. Pat. No. 2,933,223.

A number of bow making machines exist which are capable of rapidly fabricating large quantities of bows. Such machines are not satisfactory, typically, for the home production of bows by an individual wrapping gifts or making hair decorations. A bow making machine for use in the home must be simple and inexpensive so that the average person can operate the machine merely on the basis of an instruction booklet, and can afford to purchase one for a specific use.

Accordingly, there is a need for a bow making machine which is simple and strong in structure. Additionally, a bow making machine is needed which is adapted to be operated intermittently rather than substantially automatically. Such a bow making machine should be capable of producing articles of a styled, distinctive or individualistic appearance such as is usually associated with bows formed by hand, in an economical manner. Additionally, such a bow making machine should assist in making a wide variety of bow designs as well as permit the bows to be attached, during the forming process, to selected articles, such as a hair barrette or a backing card for gift adornment. The present invention fulfills these needs and provides other related advantages.

SUMMARY OF THE INVENTION

The present invention resides in an improved bow making machine for home use which is constructed economically, is easy to understand and use, and which is capable of forming many different types of bows. The present invention further resides in an improved method of making decorative bows. The bow making machine comprises, generally, a base, a plurality of posts which extend away from the base, and which are configured to hold bow-forming material therebetween, and a ribbon/staple holder adapted for placement between the posts and over the bow-forming material. Means are also provided for binding together the bow-forming material where it is held between the base and the ribbon/staple holder.

In one preferred embodiment, the base includes an anvil between the plurality of posts, and a permanent magnet adjacent to the anvil. The ribbon/staple holder includes a staple-receiving slot, and the posts comprise two pairs of equidistantly spaced channel-forming posts adapted to receive and hold a portion of bow-forming material as well as the ribbon/staple holder therebetween.

The binding means includes a retractable punch assembly attached to the base. The punch assembly includes means for stapling the portion of the bow-forming material together while it is secured between the ribbon/staple holder and the base. The punch assembly includes a support arm pivotally attached to the base, and a punch mechanism positioned by the support arm. The punch mechanism is alignable with the staple-receiving slot of the ribbon/staple holder, for driving a staple therethrough into engagement with the anvil. The punch mechanism is spring-biased and includes means for limiting travel of the punch mechanism relative to the support arm.

The support arm is pivotable between a first, open position, and a second, closed position. In the first position, a user is permitted access to the posts and the portion of the bow-forming material. In the second position, the punch mechanism overlies the ribbon/staple holder to drive the staple through the ribbon/staple holder into engagement with the anvil.

A method of making a decorative bow, in accordance with the present invention, comprises the steps of placing one or more loops of a bow-forming material within a channel, and then situating a ribbon/staple holder over the loops and within the channel. A portion of the loops of the bow-forming material within the channel is bound together, and thereafter the bound-together loops of bow-forming material are removed from the channel.

More particularly, a method of making a decorative bow in accordance with the present invention includes the steps of providing a base having an upwardly facing channel, and magnetizing a portion of the channel. After one or more loops of the bow-forming material are placed within the channel, it is shaped as desired, a ribbon/staple holder is placed over the loops within the channel, and then a staple is placed in the ribbon/staple holder. A punch mechanism is pivoted into alignment over the ribbon/staple holder, and is pressed to drive the staple into engagement with the anvil to bind together the loops of the bow-forming material within the channel. The bound-together loops of bow-forming material are removed from the channel, and the loops are then spread into a desired configuration, if needed.

A backing card may be placed within the channel prior to placing the bow-forming material therein. When the bow-forming material is wider than the width of the channel, a part of the bow-forming material may be cut away in order to position the remainder within the channel, rather than compacting it. The loops of the bow-forming material may be fastened together with the backing card and, following removal from the channel, the loops may be spread.

Alternatively, the top of a metal hair barrette may be placed within the channel prior to placing the loops of bow-forming material therein. The loops of bow-forming material may be spread into a desired configuration over the barrette after fastening them together and removing the same from the channel.

Other features and advantage of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
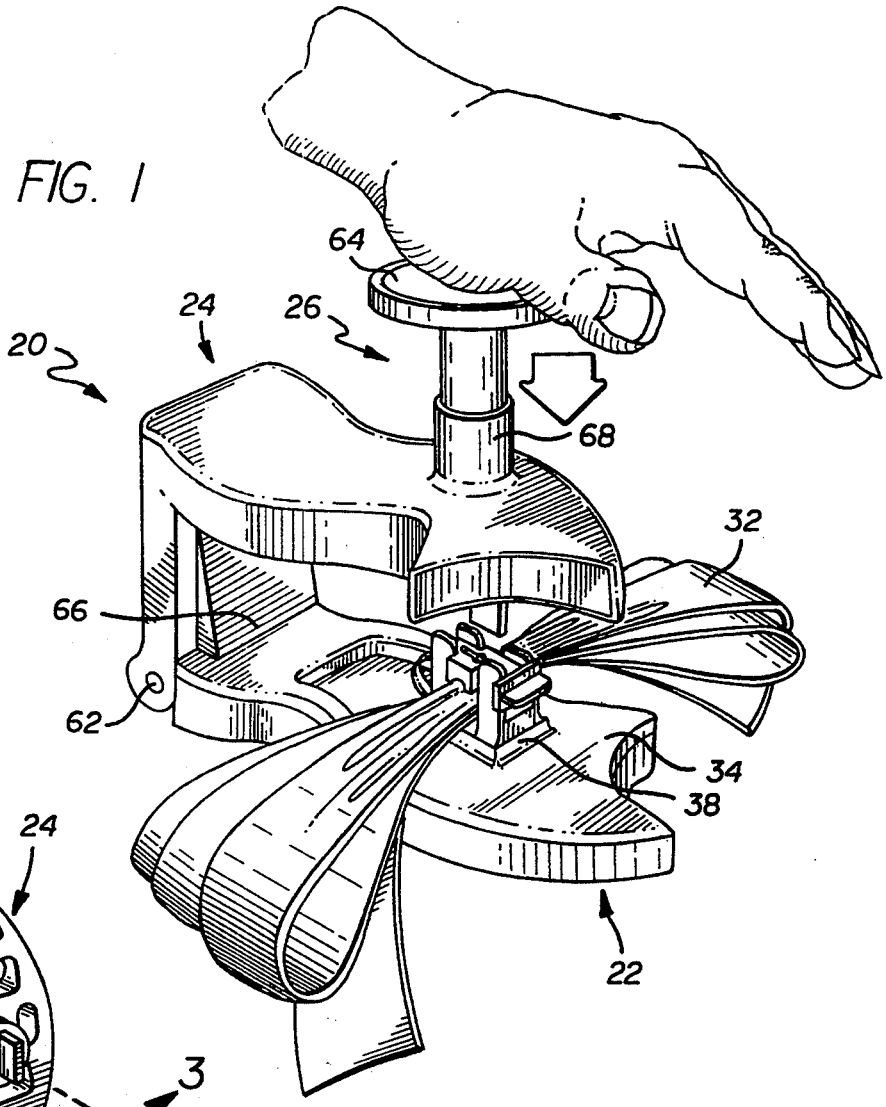
FIG. 1 is a perspective view of a bow making machine embodying the present invention, illustrating the step of pressing a punch mechanism to bind several loops of bow-forming ribbon material together with a staple fastener.
Figure 2:
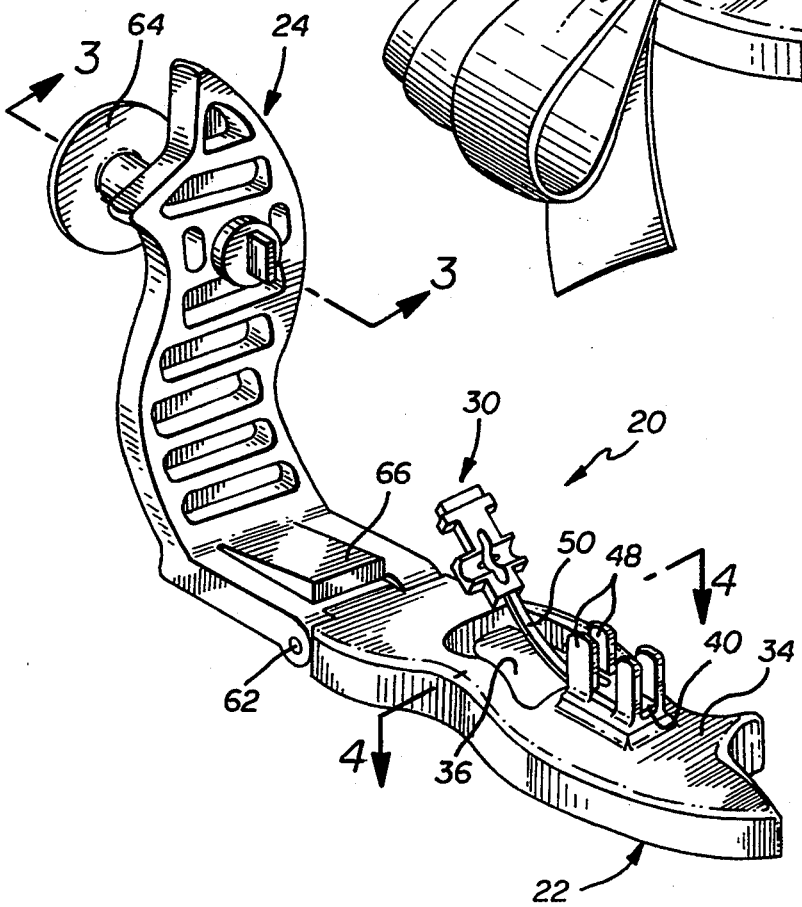
FIG. 2 is a perspective view of the bow making machine shown in FIG. 1, wherein a support arm pivotally attached to a base is pivoted into a first, open position (in comparison with a second, closed position shown in FIG. 1)

As shown in the drawings for purposes of illustration, the present invention is concerned with a bow making machine, generally designated in the accompanying drawings by the reference number 20. In accordance with the present invention, and with reference to FIGS. 1–5, the bow making machine 20 comprises, generally, a base 22 adapted to rest on a planar horizontal surface, and a support arm 24 which is pivotally attached to one end of the base. The support arm 24 positions a punch mechanism 26 which may be hand-actuated to drive a staple 28 through a ribbon/staple holder 30 in order to bind together several loops of a bow-forming ribbon material 32.

More specifically, the base 22 is preferably a plastic injection molded member having an upper surface 34 which is provided a recess 36 suitable for holding extra staples 28 or like articles. A raised portion 38 of the base 22 supports an overlying metal anvil 40 which has a pair of aligned depressions 42 that are designed to guide the ends of a staple 28 toward one another during a stapling procedure to be described below. Within the base 22, beneath the anvil 40, is a permanent magnet 44 (FIG. 5), which serves to magnetize the anvil such that when a magnetizable object is placed over the anvil, it tends to remain in place (see, for example, the barrette 46 of FIGS. 6–9).

Extending upwardly from the raised portion 38 of the base 22 are four channel-forming posts 48. The horizontal spacing between each adjacent post 48 is generally equal, and the anvil 40 forms a floor extending between each of the posts. The posts 48 serve as a guide for the placement of the bow-forming ribbon material 32 and form a channel which compacts the bow-forming ribbon material to a width narrow enough for the legs of the staple 28 to pass by, and also serve to hold the ribbon/staple holder 30 securely in place atop the bow-forming material 32.

Figure 8:
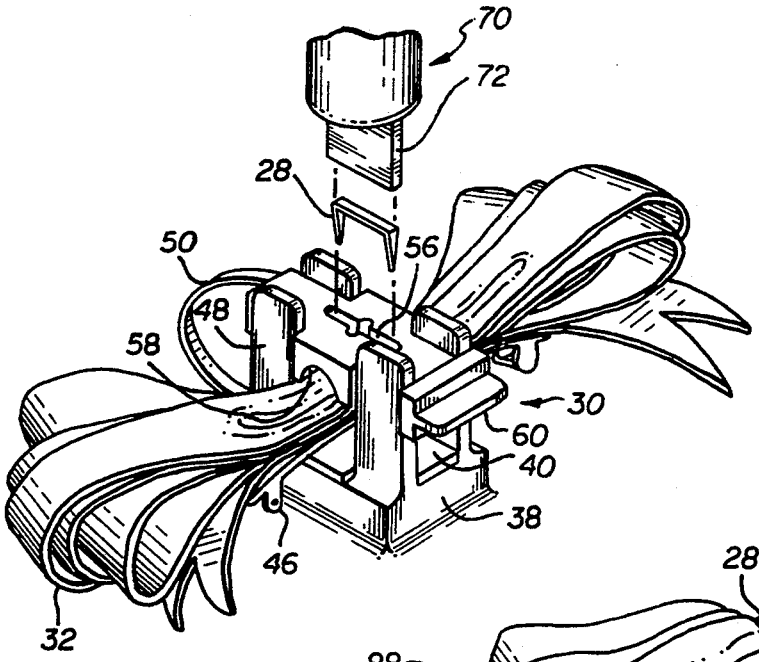
FIG. 8 is a perspective view similar to FIGS. 6 and 7, illustrating the steps of placing a ribbon/staple holder over a portion of the bow-forming material to hold it down within the channel, and then placing a staple fastener within a slot of the ribbon/staple holder prior to pressing the punch mechanism to drive the staple into the anvil and fasten the bow-forming material to the barrette.
Figure 9:
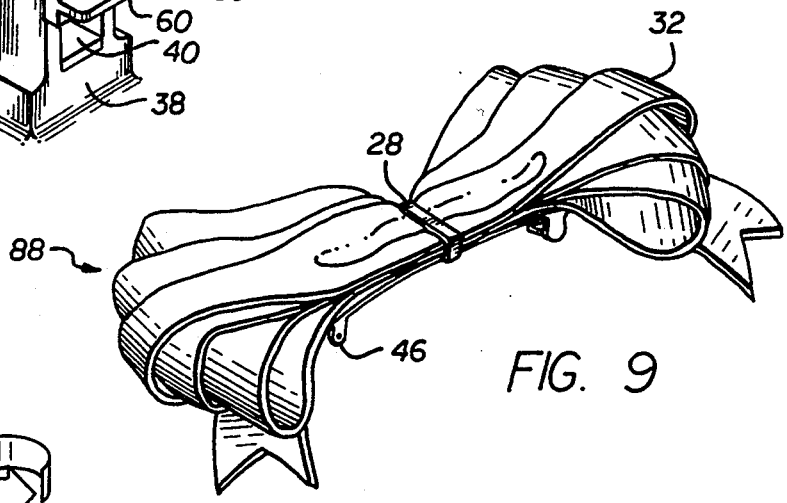
FIG. 9 is a perspective view of the fastened-together bow-forming material and the barrette, resulting from the steps illustrated in FIGS. 6–8.

The ribbon/staple holder 30 includes a tether 50 secured at one end to the base 22 by a screw 52. The ribbon/staple holder 30 is configured such that wings 54 fit snugly between adjacent posts 48 when placed therebetween as illustrated in FIGS. 1 and 8. A staple-receiving slot 56 is provided through the ribbon/staple holder 30 which, when the ribbon/staple holder is placed between the posts 48, aligns the ends of the staple 28 with the depressions 42 in the anvil 40. The undersurface of the ribbon/staple holder 30 includes a semicircular cutout portion 58 extending the width of the ribbon/staple holder, in order to accommodate varying thicknesses and shapes of the bow-forming ribbon material 32 which is to be sandwiched between the anvil 40 and the ribbon/staple holder 30 during the stapling process. Additionally, an integrally molded handling flange 60 is provided adjacent to a wing 54 opposite the tether 50, to facilitate placement of the ribbon/staple holder 30 between the posts 48 and removal therefrom.

The support arm 24 is attached to the base 22 by means of a pivot shaft 62, which permits the support arm to be moved between a first, open position (FIG. 2), and a second, closed position (FIG. 1). In the first or open position, the user is given complete access to the channel-forming posts 48 and associated structure of the base 22, in order to place the bow-forming ribbon material 32, a barrette 46 if desired, or other items therein prior to binding the portion situated over the anvil 40 and below the ribbon/staple holder 30 together during the stapling process. Movement of the support arm 20 into its closed or second position aligns the punch mechanism 26 with the staple-receiving slot 56 of the ribbon/staple holder 30 when it is properly placed between the posts 48. In this position, and with a staple 28 placed within the staple-receiving slot 56 of the ribbon/staple holder 30, the user simply presses a handle 64 of the punch mechanism 26 in order to drive the staple into the anvil 40, wherein it is reshaped to bind together the materials disposed between the posts 48.

The support arm 24 is generally L-shaped, and includes an integral stop member 66. The stop member 66 is configured to engage the upper surface 34 of the base 22 when the support arm 24 is pivoted into its second position, and effectively limit the arc of rotation of the support arm 24 relative to the base 22.

Figure 3:
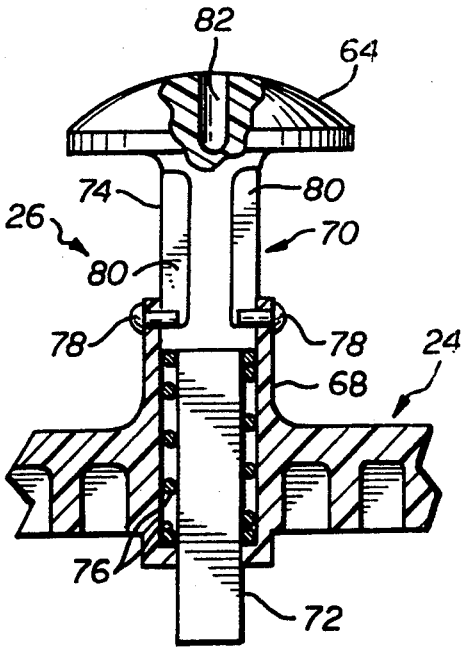
FIG. 3 is an enlarged fragmented partially sectional view taken generally along the line 3—3 of FIG. 2, illustrating the punch mechanism positioned by the support arm.
Figure 4:
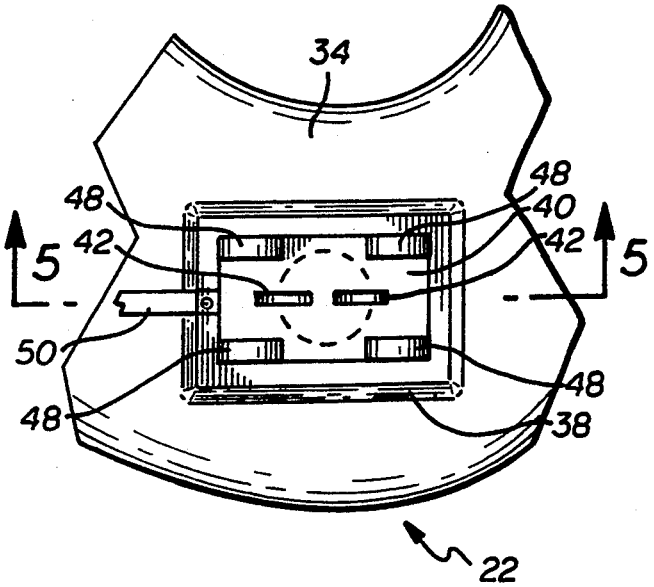
FIG. 4 is an enlarged, fragmented top plan view of the base, taken generally along the line 4—4 of FIG. 2.
Figure 5:
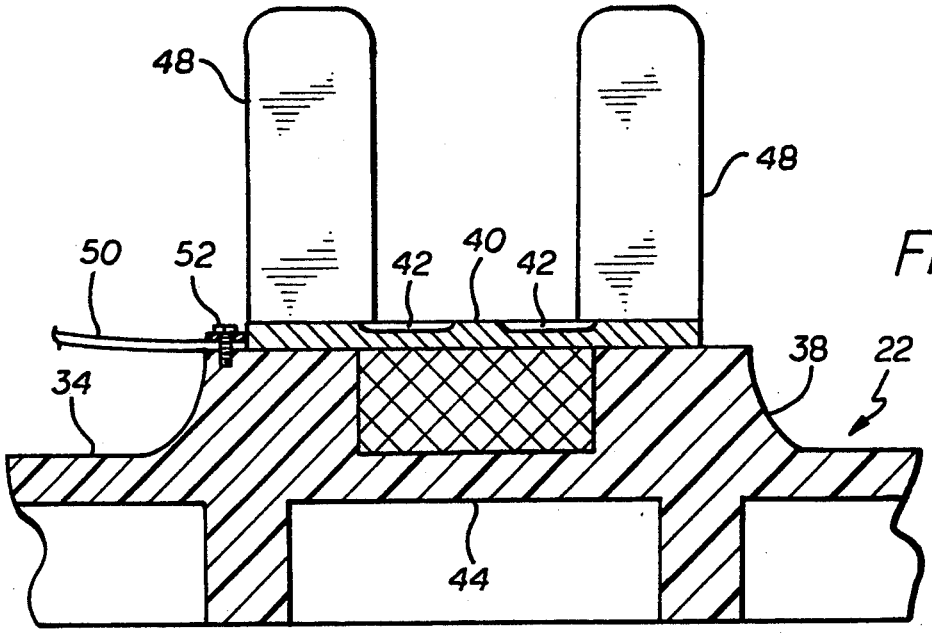
FIG. 5 is an enlarged, fragmented sectional view taken generally along the line 5—5 of FIG. 4, illustrating the construction of a portion of the base wherein a magnet is positioned immediately below an anvil.

As shown in FIG. 3, the punch mechanism 26 includes a generally cylindrical housing 68 provided by the support arm 24, and a punch 70 within the housing 68 that is permitted to move linearly therethrough. The punch 70 includes a staple engaging head 72 having a rectangular cross section and which is disposed at a lower end thereof, the handle 64, and a connecting shaft 74 which extends between the handle and the staple engaging head 72. The punch 70 is biased upwardly relative to the support arm 24 by means of a spring 76. A pair of stops 78 extend through the housing 68 into grooves 80 provided in the side of the connecting shaft 74, which serve to limit the travel of the punch 70 through the housing 68 as the stops 78 engage opposite ends of the grooves 80. The handle 64 is further provided a cylindrical recess 82 which is configured to receive the bottom end of a shaft 84 of a ribbon loop winding apparatus 86, shown in FIG. 10.

When utilizing the bow making machine 20 of the present invention, it is often desirable to fashion bows 88 from several superimposed loops of the ribbon material 32. The ribbon loop winding apparatus 86 shown in FIG. 10 simplifies the process by wrapping the ribbon material about a pair of parallel posts 90 during an operation wherein a roll of the ribbon material 32 may be simply placed on a suitable spindle 92. More particularly, the ribbon loop winding apparatus 86 comprises the shaft 84 having its lower end positioned within the cylindrical recess 82 of the handle 64, and a perpendicular post-supporting bar 94. The bar is provided with a number of post-receiving recesses 96, which permit a user to appropriately space the posts 90 to obtain ribbon loops of a desired length. One or both of the posts 90 may be provided with a slot for anchoring a portion of the ribbon material 32 therein. The upper end of the shaft 84 is provided a knob 98 which may be grasped for rotating the shaft 84 in order to wind ribbon material 32 about the posts 90.

Use of the bow making machine 20 will now be described with reference to FIGS. 6–9, which illustrate a method of making a decorative bow and attaching it to a supporting article, such as the barrette 46.

Figure 6:
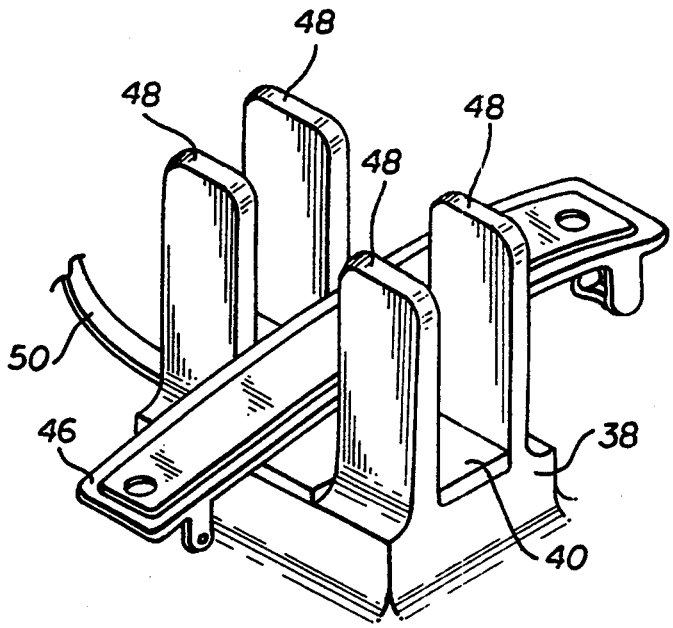
FIG. 6 is a fragmented perspective view of a portion of the base including four upstanding, channel-forming posts associated with the anvil, wherein an upper portion of a barrette is positioned within the channel over the anvil.
Figure 7:
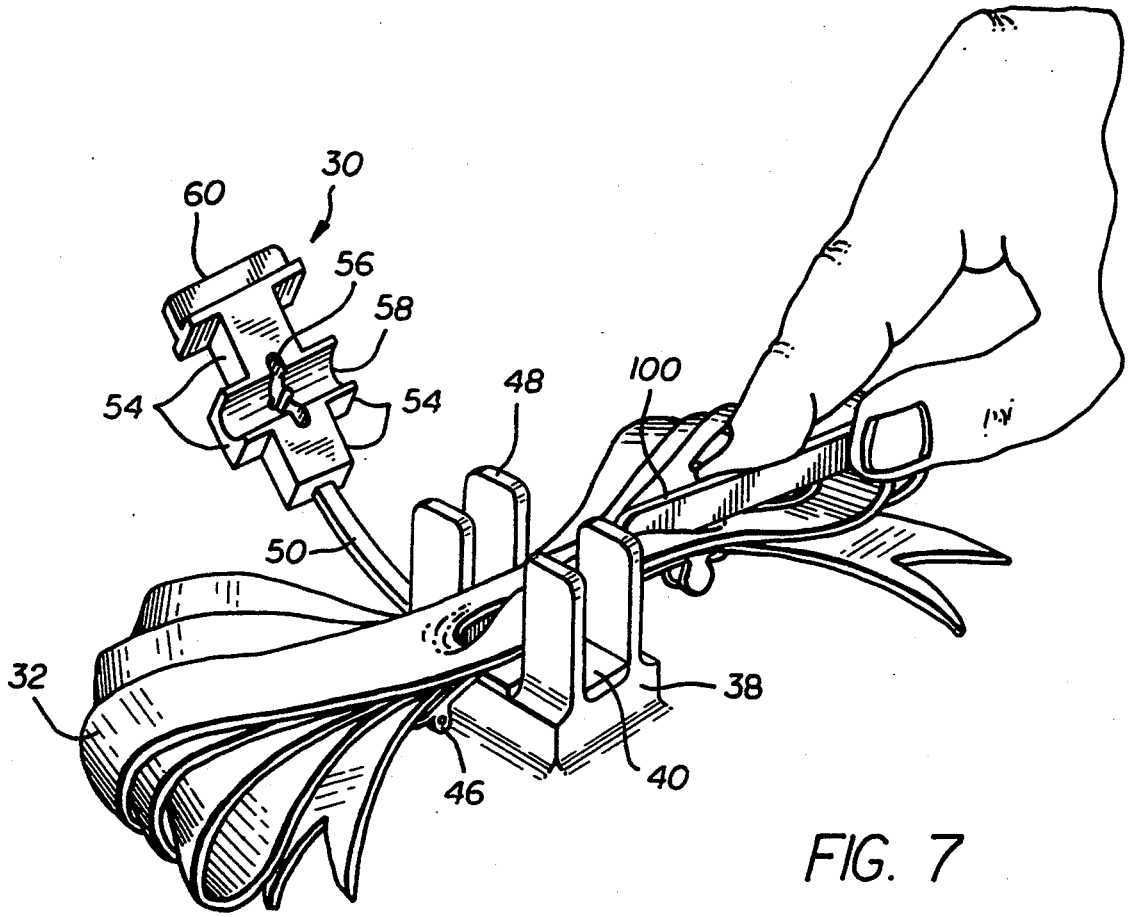
FIG. 7 is a perspective view similar to that shown in FIG. 6, illustrating the step of placing several loops of bow-forming material over the barrette within the channel, where it is compacted to the width of the channel, and shaping the bow-forming material within the channel utilizing a tool in accordance with the method of the present invention.

When it is desired to create a bow and attach it to another article, such as the barrette 46, that article is first placed between the posts 48 immediately over the anvil 40. Referring to FIG. 6, the metal barrette 46 is placed so that it lies immediately adjacent to and in contact with the metal anvil 40 and is magnetically held in place by means of the permanent magnet 44 disposed below the anvil. The ribbon material 32 is then placed over the barrette 46 and also between the posts 48. Typically, the ribbon material 32 is centered over the barrette 46, and the user may utilize a shaping tool 100 (FIG. 7) to provide a properly placed "pucker" in the ribbon material.

After the ribbon material 32 is placed as desired over the barrette 46, the ribbon/staple holder 30 is placed over the ribbon material 32 between the posts 48. If desired, the ribbon loops can be spread or otherwise reshaped at this point, and then a staple 28 is placed into the staple-receiving slot 56. The support arm 24 is then pivoted into the second or closed position which aligns the staple engaging head 72 of the punch mechanism 26 with the staple-receiving slot 56 (see FIG. 8). In order to bind the central portion of the bow-forming ribbon material 32 to the barrette 46, all that is required is that user press the handle 64 (see FIG. 1), which causes the staple 28 to engage the anvil 40 at the depressions 42, and clasp the materials between the anvil 40 and ribbon/staple holder 30 together (see FIG. 9). Even after the ribbon material 32 and the barrette 46 have been fastened together, the user may still spread the loops 102 of the ribbon material 32 into a desired shape or configuration, and the process can be repeated with additional ribbon material.

Figure 10:
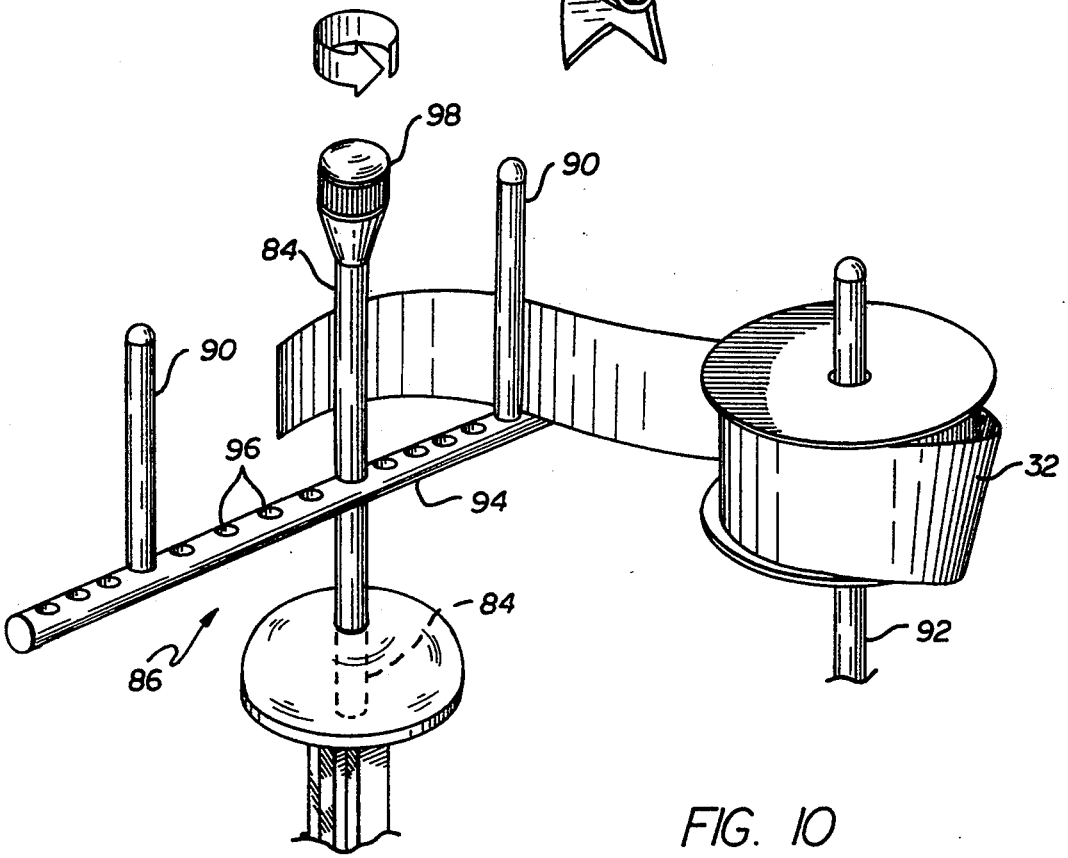
FIG. 10 is a fragmented perspective view of a ribbon loop winding mechanism positioned atop a punch mechanism handle.
Figure 11:
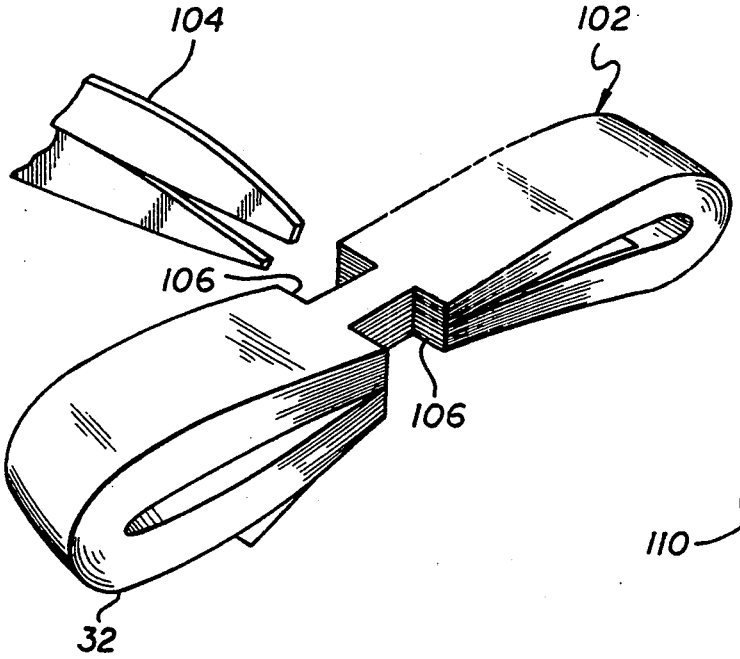
FIG. 11 is a perspective view of superimposed loops of bow-forming ribbon material which have been cut utilizing scissors to form centrally disposed notches for placement between the channel-forming posts of the base.
Figure 12:
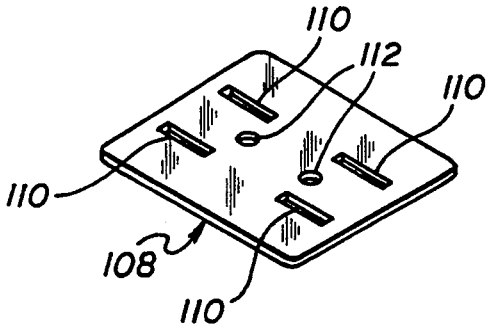
FIG. 12 is a perspective view of a backing card.
Figure 13:
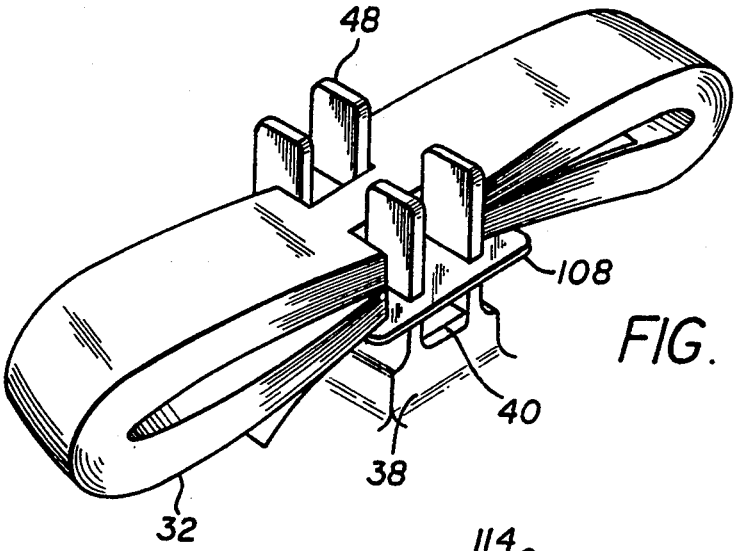
FIG. 13 is a perspective view similar to FIG. 7, illustrating the placement of the backing card over the posts, and placement of the notched bow-forming ribbon material over the backing card and within the channel, prior to the assembly being stapled together.
Figure 14:
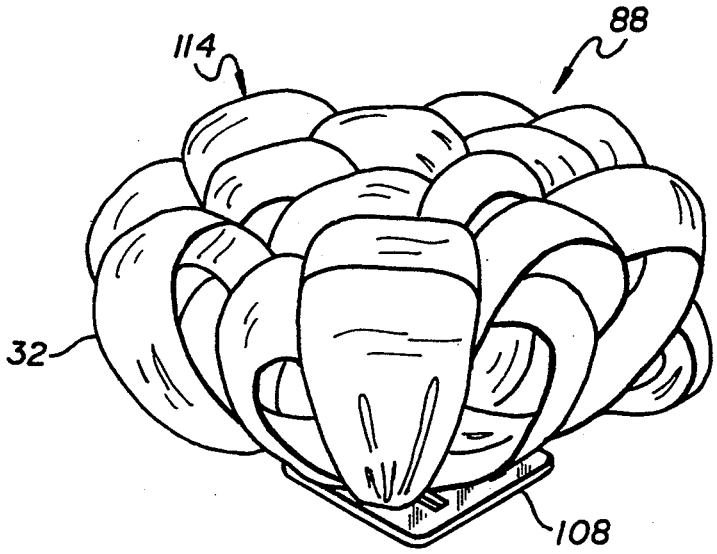
FIG. 14 is a perspective view of an exemplary bow which is formed following the binding together of the bow-forming ribbon material of FIG. 11 and the backing card of FIG. 12, in accordance with the method of the present invention.

Sometimes it is desirable to make a type of bow commonly known as a pom pom bow. In this instance, and with reference to FIGS. 10–14, the ribbon material 32 may be wound into superimposed loops utilizing the ribbon loop winding apparatus 86 (FIG. 10). For better results with this type of bow, the user would then use scissors 104 to cut-out central notches 106 from the looped ribbon material 32, as shown in FIG. 11, as opposed to forcing the full width of looped ribbon material 32 between the posts 48. A flat backing card 108 (FIG. 12) having slots 110 may be placed over the anvil 40. The slots 110 are configured to permit the posts 48 to extend upwardly through the backing card 108. The backing card 108 is further provided with a pair of apertures 112 through which the ends of the staple 28 are permitted to pass in order to directly engage the anvil 40 during the stapling process. The notched ribbon material 32 is placed directly over the backing card 108 (FIG. 13), and then the same procedure as outlined above is followed in order to secure the ribbon material 32 to the backing card 108.

More specifically, the support arm 24 is rotated into its second or closed position after the ribbon/staple holder 30 has been placed over the bow-forming ribbon material 32, and a staple is placed within the staple-receiving slot 56. The punch mechanism 26 is pressed in order to cause the staple 28 to fasten together the ribbon material 32 and backing card 108. Following the stapling procedure, the support arm 24 is pivoted back to its first or open position, the ribbon/staple holder 30 is removed from between the post 48, and then the assembly of the ribbon material 32 and the backing card 108 is removed from the base 22. At this point, the loops 102 of the ribbon material 32 may be spread and shaped in order to form the decorative bow 114 shown in FIG. 14.

From the foregoing it is to be appreciated that the bow making machine 20 is of simplified construction, lends itself well to economical manufacturing processes, and is easy to understand and utilize. Many different types of decorative bows may be made utilizing the bow making machine 20 of the present invention, thus making the bow making machine ideal for home use.

Although a particular embodiment of the invention has been described in detail for purposes of illustration, various modifications may be made without departing from the spirit and scope of the invention. Accordingly, the invention is not to be limited, except as by the appended claims.

I claim:

1. A bow making machine, comprising:

a base;

a plurality of parallel posts extending away from the base and configured to hold bow-forming material therebetween;

a holder placed over the bow-forming material between the posts; and means for binding a portion of the bow-forming material together between the base and the holder, the binding means comprising a punch assembly including a support arm attached to the base and a punch mechanism positioned by the support arm, the punch assembly being pivotable relative to the base between a first position and a second position, wherein in the first position the punch mechanism is displaced away from the posts and the holder, and wherein in the second position the punch mechanism overlies the holder.

2. The bow making machine of claim 1, wherein the punch mechanism is spring-biased and includes means for limiting travel of the punch mechanism relative to the support arm.

3. The bow making machine of claim 1, wherein the base includes an anvil between the plurality of posts.

4. The bow making machine of claim 3, wherein the base includes a permanent magnet adjacent to the anvil.

5. The bow making machine of claim 4, wherein the holder includes a staple-receiving slot, and wherein when the punch assembly is pivoted to its second position, the punch mechanism is aligned with the staple-receiving slot for driving a staple therethrough into engagement with the anvil.

6. The bow making machine of claim 1, wherein the posts comprise two pairs of equidistantly spaced, channel-forming posts adapted to receive and hold the portion of the bow-forming material and the holder therein.

7. The bow making machine of claim 6, including a backing card adapted to be placed over the posts and positioned adjacent to the base such that the binding means attaches the portion of the bow-forming material to the backing card.

8. The bow making machine of claim 1, including a ribbon loop winder having a shaft rotatably supported on the punch assembly, a post-supporting bar fixed to the shaft and extending perpendicularly thereto, and a loop-winding post supported by the bar and extending generally parallel to the shaft.

9. The bow making machine of claim 8, wherein the bar includes post-receiving apertures which permit adjustment in the spacing of the loop-winding post relative to the shaft.

10. A bow making machine, comprising:

a base;

an anvil overlying a portion of the base;

two pairs of equidistantly spaced, channel-forming posts extending upwardly from the base and the anvil, and configured to hold bow-forming material therebetween and over the anvil;

a holder placed between the posts and over the bow-forming material, the holder including a staple-receiving slot; and means for binding a portion of the bow-forming material together between the anvil and the holder, wherein the binding means includes a punch assembly pivotally attached to the base and moveable between a first position and a second position, the punch assembly including means for stapling the portion of the bow-forming material together when secured between the holder and the anvil.

11. The bow making machine of claim 10, wherein the punch assembly includes a support arm pivotally attached to the base and a punch mechanism positioned by the support arm, wherein the support arm is pivotable between the first position permitting a user access to the posts and the portion of the bow-forming material therein, and the second position wherein the punch mechanism overlies the holder to drive a staple through the holder into engagement with the anvil.

12. The bow making machine of claim 10, wherein the base includes a permanent magnet adjacent to the anvil.

13. A bow making machine, comprising:

a base including an anvil;

a plurality of parallel posts extending away from the base and configured to hold bow-forming material therebetween and over the anvil;

means for holding a staple between the posts and over the anvil; and means for binding together a bow-forming material between the anvil and the staple, the binding means comprising a punch assembly including a support arm attached to the base and means positioned by the support arm for driving the staple into the anvil to effect stapling of the bow-forming material together, the punch assembly being pivotable between a first position and a second position, wherein in the first position the staple driving means is displaced away from the holding means to permit a user access to a space between the posts, and wherein in the second position the staple driving means overlies the anvil to drive the staple into engagement with the anvil.

14. The bow making machine of claim 13, wherein the base includes a magnet adjacent to the anvil.

15. The bow making machine of claim 13, wherein the staple holding means comprises a staple holder placed between the posts and over the anvil, the staple holder including a staple-receiving slot, wherein the staple driving means is displaced from the staple-receiving slot when the punch assembly is in the first position, and wherein the staple driving means is aligned with the staple-receiving slot when the punch assembly is in the second position, for driving the staple therethrough into engagement with the anvil.

16. The bow making machine of claim 13, wherein the posts comprise two pairs of equidistantly spaced, channel-forming posts for receiving and holding the bow-forming material therebetween.

17. The bow making machine of claim 13, including a backing card placed over the posts and positioned adjacent to the base such that the binding means attaches the bow-forming material to the backing card.

18. The bow making machine of claim 13, including a ribbon loop winder having a shaft rotatably supported on the punch assembly, a post-supporting bar fixed to the shaft and extending perpendicularly thereto, and a loop-winding post supported by the bar and extending generally parallel to the shaft.

19. The bow making machine of claim 18, wherein the bar includes post-receiving apertures which permit adjustment in the spacing of the loop-winding post relative to the shaft.

* * * * *